US008714672B2

(12) United States Patent
Heckler

(10) Patent No.: US 8,714,672 B2
(45) Date of Patent: May 6, 2014

(54) APPLIANCE DOOR

(75) Inventor: James Arthur Heckler, Auckland (NZ)

(73) Assignee: Fisher & Paykel Appliances Limited, Auckland (NZ)

( * ) Notice: Subject to any disclaimer, the term of this patent is extended or adjusted under 35 U.S.C. 154(b) by 62 days.

(21) Appl. No.: 12/942,665

(22) Filed: Nov. 9, 2010

(65) Prior Publication Data

US 2011/0115355 A1 May 19, 2011

Related U.S. Application Data

(60) Provisional application No. 61/261,041, filed on Nov. 13, 2009.

(51) Int. Cl.
*A47B 96/04* (2006.01)
*A47B 49/00* (2006.01)

(52) U.S. Cl.
USPC ..... 312/405; 312/326

(58) Field of Classification Search
USPC ..... 312/405, 326–329, 204, 401, 406, 312/406.1; 428/692.1, 693.1; 220/592.1, 220/592.09, 592.03, 592.02
See application file for complete search history.

(56) References Cited

U.S. PATENT DOCUMENTS 2,231,216 A * 2/1941 Nystrom ..... 52/787.11
2,779,066 A * 1/1957 Gaugler et al. ..... 312/406
2,959,832 A * 11/1960 Baermann ..... 24/303
3,078,003 A * 2/1963 Kesling ..... 220/592.1
3,256,442 A * 6/1966 Sedlak ..... 250/519.1
3,314,196 A * 4/1967 Betz et al. ..... 49/501
3,674,359 A * 7/1972 Crowe ..... 312/407
3,813,137 A 5/1974 Fellwock et al.
3,923,355 A 12/1975 Dietterich
3,944,111 A 3/1976 Nonomaque et al.
4,005,919 A * 2/1977 Hoge et al. ..... 312/406
4,048,274 A * 9/1977 Hoge et al. ..... 264/46.5
4,134,626 A * 1/1979 Kordes ..... 312/405
4,183,393 A * 1/1980 Bailey ..... 160/232
4,196,950 A * 4/1980 Churchill et al. ..... 312/406
4,476,183 A * 10/1984 Holtrop et al. ..... 442/372
4,707,401 A * 11/1987 Benford ..... 428/317.5
4,917,256 A * 4/1990 Kruck et al. ..... 220/4.28
4,996,110 A * 2/1991 Tanuma et al. ..... 428/343
5,007,226 A * 4/1991 Nelson ..... 52/784.15
5,044,705 A * 9/1991 Nelson ..... 312/228

(Continued)

FOREIGN PATENT DOCUMENTS

EP 0 468 575 7/1991
EP 0 838 645 4/1998

(Continued)

*Primary Examiner* — Darnell Jayne
*Assistant Examiner* — Kimberley S Wright
(74) *Attorney, Agent, or Firm* — Clark Hill PLC

(57) ABSTRACT

The present invention relates to a door for an appliance. The door has a front panel and a rear panel and edges extending between the front panel and rear panel to create an internal cavity between the front panel and the rear panel. A filler material is contained in the internal cavity, and an intermediate material is interposed between a rear surface of the front panel and the filler material. The intermediate material or front panel is adapted to retain the front panel relative to the filler material by a magnetic field and release a portion of the front panel relative to the filler material upon excessive localized deformation of the filler material.

19 Claims, 3 Drawing Sheets

(56) References Cited

U.S. PATENT DOCUMENTS

| | | | | | |
|---|---|---|---|---|---|
| 5,153,388 | A | * | 10/1992 | Wittenmayer et al. | 181/290 |
| 5,168,621 | A | * | 12/1992 | Kruck et al. | 29/451 |
| 5,173,517 | A | | 12/1992 | Kuroishi et al. | |
| 5,524,373 | A | * | 6/1996 | Plumly | 40/600 |
| 5,527,105 | A | * | 6/1996 | Riach, Jr. | 312/406 |
| 5,533,312 | A | * | 7/1996 | Mihalcheon | 52/309.9 |
| 5,588,731 | A | * | 12/1996 | Schmidt et al. | 312/405 |
| 5,599,081 | A | * | 2/1997 | Revlett et al. | 312/406 |
| 5,705,215 | A | * | 1/1998 | Riach, Jr. | 426/237 |
| 5,720,142 | A | * | 2/1998 | Morrison | 52/309.9 |
| 5,800,896 | A | * | 9/1998 | Kobayashi | 428/67 |
| 5,897,932 | A | * | 4/1999 | McGarth et al. | 428/69 |
| 5,904,024 | A | * | 5/1999 | Miwa | 52/309.1 |
| 5,927,033 | A | * | 7/1999 | Kreckl | 52/390 |
| 6,064,041 | A | * | 5/2000 | Staffieri | 219/399 |
| 6,430,780 | B1 | | 8/2002 | Kim et al. | |
| 6,455,146 | B1 | * | 9/2002 | Fitzgerald | 428/318.4 |
| 6,986,822 | B1 | * | 1/2006 | Poulakis | 156/245 |
| 2007/0059498 | A1 | * | 3/2007 | Anderson et al. | 428/195.1 |
| 2007/0267771 | A1 | * | 11/2007 | Earnest | 264/46.4 |

FOREIGN PATENT DOCUMENTS

| | | |
|---|---|---|
| EP | 1 505 359 | 2/2005 |
| JP | 61-141690 | 9/1986 |
| JP | 8-136120 | 5/1996 |
| WO | 2008/117911 | 10/2008 |

* cited by examiner

APPLIANCE DOOR

FIELD OF THE INVENTION

The present invention relates to a door of an appliance. More specifically, the present invention relates to a refrigerator door.

BACKGROUND TO THE INVENTION

Appliances such as refrigerators and dishwashers have a door providing access to an internal chamber or compartment within the appliance. Refrigerator door construction typically comprises a front or external panel including edges, a rear or interior panel, an upper door cap and a lower door cap, and internal foam insulation installed between the front and rear panels. Appliance doors traditionally have a convex front panel, the convex curve of the door front panel noticeable in a horizontal plane through the door. However, modern appliance design has introduced appliances with doors comprising a flat front panel. Such appliances are typically premium products designed for the higher end of the market and may feature flat doors with an unpainted bright stainless steel finish, or flat doors with a clear lacquer or coating that provides a bright or reflective stainless steel finish.

Obtaining an acceptably flat door finish can be difficult. Even a slight depression or shape irregularity in a bright or reflective flat front panel can be noticeable to the eye. Such shape defects or irregularities are extremely undesirable.

Shape defects can be introduced by shrinkage of the internal insulating foam during manufacture or at some time after manufacture. During the foaming process during the door manufacture, the foam bonds to an inside surface of the door front panel. Shrinkage of the foam during cooling may occur. Also, foam shrinkage can occur due to other causes over time, for example over a period of months post manufacture. As the foam is bonded to the door panel, the foam shrinkage can pull the front panel of the door inwards. Irregularities in the amount of shrinkage can cause localized shape defects which become apparent in the flat or bright or highly reflective surface of the door. The same shape defects may be present in a door with a duller finish. However in less reflective doors such as a door with a painted or embossed finish, shape defects are less visible or apparent to a user. Also, a door with a curved front panel may also include shape defects caused by foam shrinkage, but the added panel stiffness achieved by the curvature of the front panel helps to resist the foam shrinkage resulting in smaller and less visible shape defects.

A number of solutions to overcome shape defects caused by foam shrinkage have been proposed. JP61-141690 discloses a refrigerator door with an intermediate member between the internal foam and the door front panel. The intermediate material is not bonded to the front panel so that foam shrinkage does not pull the front panel inwards.

EP1505359 suggests the door of JP61-141690 results in a bad touch due to a clearance between the front panel and the foam caused by the foam shrinkage. EP1505359 discloses a resin foam intermediate layer in between the internal foam and the door outer panel. Shrinkage of the insulating foam is absorbed by expansion of the resin foam so that deformation of the outer panel is prevented.

Another method for dealing with shape defects in flat doors is to select a dull or less bright or less reflective surface finish for the door to hide or obscure the effect of shape defects.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

It is an object of the present invention to provide an improved appliance door, or to at least provide the industry with a useful choice for an appliance door construction.

SUMMARY OF THE INVENTION

In one aspect, the present invention broadly consists in a door for an appliance comprising:

- a front panel and a rear panel and edges extending between the front panel and rear panel to create an internal cavity between the front panel and the rear panel,
- a filler material in the internal cavity,
- intermediate material between a rear surface of the front panel and the filler material, wherein
- the intermediate material or front panel is adapted to retain the front panel relative to the filler material by a magnetic field and release a portion of the front panel relative to the filler material upon excessive localized deformation of the filler material.

Preferably the intermediate material comprises at least one permanent magnet providing the magnetic field.

Preferably the at least one permanent magnet is a magnet sheet.

Preferably the magnet sheet is bonded to the filler material, at least a portion of the front panel retained relative to the filler material by the magnetic field of the magnet sheet.

Preferably the front panel is magnetically attracted to the magnet sheet.

Preferably the intermediate material further comprises a second material, the second material being non magnetic and positioned in between the magnetic sheet and the rear surface of the front panel thereby spacing the magnet sheet from the rear surface of the front panel by the thickness of the second material.

Preferably a first portion of the rear surface of the front panel is covered by the second material and a second portion of the rear surface of the front panel is not covered by the second material.

Preferably the second portion is an edge region of the front panel.

Preferably the thickness of the second material varies over at least a section of the door.

Preferably the second material comprises at least two sheets of material, a first sheet covering a first area of the rear surface of the front panel and a second sheet covering a second area of the rear surface of the front panel, the first and second areas being different thereby varying the thickness of the second material.

Preferably the second material is one or more sheets of paper.

Preferably the thickness of the second material is thinner in an edge region of the front panel.

Preferably the magnet sheet is bonded to the rear surface of the front panel and the intermediate material further comprises second material bonded to the filler material, the second material being magnetically attracted to the magnet sheet, at least a portion of the front panel retained relative to the filler material by the magnetic field of the magnet sheet.

Preferably the second material is a second magnet sheet or a metal sheet.

Preferably the second material reinforces the filler material.

Preferably the magnet sheet is bonded to a second material, the second material being bonded to the filler material, at least a portion of the front panel retained relative to the filler material by the magnetic field of the magnet sheet.

Preferably the front panel is magnetically attracted to the magnet sheet.

Preferably the intermediate material further comprises a third material bonded to the rear surface of the front panel, the third material being magnetically attracted to the magnet sheet.

Preferably the second material reinforces the filler material or the third material reinforces the door front panel, or both.

Preferably the intermediate material-further comprises a second material bonded to the filler material, the second material attracted to the magnet sheet.

Preferably the intermediate material further comprises a second material bonded to the rear surface of the front panel, the second material being magnetically attracted to the magnet sheet.

Preferably grooves are formed in a side of the magnet sheet facing the rear surface of the front panel.

Preferably a side of the magnet sheet facing the rear surface of the front panel is textured.

Preferably the magnet sheet covers a first portion of the rear surface of the front panel and is absent over a second portion of the rear surface of the front door panel, the filler material being permanently coupled to the front door panel where the magnet sheet is absent.

Preferably the magnet sheet is absent in an edge region of the front panel.

Preferably the magnet sheet has a magnetic pole density having alternating magnetic poles occurring at a pitch of 0.5 mm to 5 mm.

Preferably the pitch varying over at least a portion of the magnet sheet.

Preferably the pitch is smaller in an edge region of the front panel compared to another region of the front panel.

Preferably the magnet sheet has a variation in magnetization level across the sheet, one region of the sheet having a higher magnetization level than another region of the sheet.

Preferably the magnet sheet has a region having no magnetization.

Preferably the intermediate material comprises a plurality of permanent magnets spaced apart over an area of the front panel Preferably the intermediate material further comprises a second material positioned in between the plurality of magnets and the rear surface of the front panel, the filler material bonded to the plurality of magnets and a rear surface of the second material.

Preferably the second material is a sheet of paper.

Preferably the second material is absent in some areas of the front panel, the filler material being permanently coupled to the front door in said areas.

Preferably the magnets are arranged in areas of varying density, some areas comprising a higher number of magnets compared to other areas.

Preferably the magnet sheet is formed of permanent magnet material integrally formed with a polymer sheet.

Preferably the filler material is insulation material.

Preferably the filler material is a foam material.

Preferably the door is a refrigerator door.

In a second aspect the present invention broadly consists in a door for an appliance comprising:

a front panel and a rear panel and edges extending between the front panel and rear panel to create an internal cavity between the front panel and the rear panel, a filler material in the internal cavity, intermediate material between a rear surface of the front panel and the filler material, wherein the intermediate layer allows a portion of the front panel to move away from the filler material by a separation distance, the intermediate layer providing a decreasing holding force between the front panel and the filler material for an increasing separation distance, the intermediate material releasing a portion of the front panel relative to the filler material upon excessive localized deformation of the filler material.

Preferably the intermediate layer comprises at least one permanent magnet.

In a third aspect the present invention broadly consists in a door for a refrigerator comprising:

a front panel and a rear panel and edges extending between the front panel and rear panel to create an internal cavity between the front panel and the rear panel, an insulation material in the internal cavity, intermediate material between a rear surface of the front panel and the insulation material, wherein the intermediate material comprises at least one permanent magnet providing a magnetic field, the intermediate material adapted to retain the front panel relative to the insulation material by the magnetic field and release a portion of the front panel relative to the insulation material upon excessive localized deformation of the insulation material.

In a forth aspect the present invention consists in an appliance including a door as described above.

The term "comprising" as used in this specification and claims means "consisting at least in part of". When interpreting each statement in this specification and claims that includes the term "comprising", features other than that or those prefaced by the term may also be present. Related terms such as "comprise" and "comprises" are to be interpreted in the same manner.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

The invention consists in the foregoing and also envisages constructions of which the following gives examples only.

BRIEF DESCRIPTION OF THE DRAWINGS

Preferred embodiments of the invention will be described by way of example only and with reference to the drawings. The drawings are schematic representations only.

DETAILED DESCRIPTION

Figure 1:
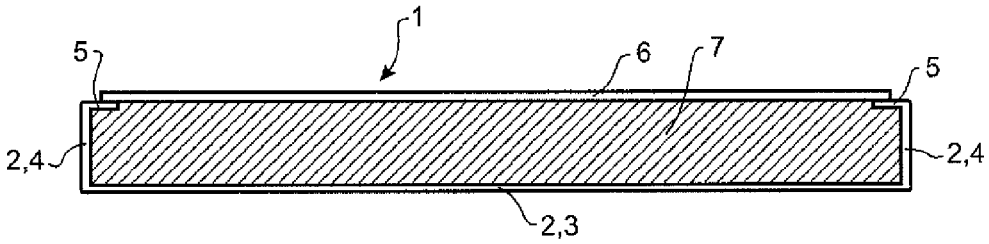
FIGURE 1 (Prior Art)
FIG. 1 is a cross section of a prior art refrigerator door.

FIG. 1 is a cross section through a prior art refrigerator door. The door may be mounted to the appliance cabinet via a hinge or hinges to pivot about a hinge axis between an open and a closed position. Alternatively the door may form the front of a drawer, in a closed position the front of the drawer closing the appliance cabinet. The door 1 comprises an outer door skin 2. Outer door skin 2 may be made from a flat sheet of material. The edge regions of a blank of sheet material such as a sheet of stainless steel are folded at a right angle to the plane of the front panel 3 of the door to create edges 4 of the door. All four edge regions of the blank may be folded to create four edges extending the full perimeter of the door. Corner locations between two adjacent edges may be welded. Alternatively, a separate part such as a plastic moulding may be attached at the corner of a door between two adjacent edges 4 of the door. Alternatively, vertical edges of the door 4 may be folded from the blank forming the front door panel, and the upper and lower edges of the door may be separate end caps (not shown), formed for example from a plastic material fitted to the outer door skin 2. The front panel 3 of the door extending between the edges 4 of the door is substantially flat. The radius between the front panel 3 and the edges 4 of the door may be relatively tight; for example in the order of less than 5 mm. The outer door skin 2 may further include flanges 5 for securing to an inner door panel or skin 6. A filler material, for example insulating foam 7, is added to an interior cavity of the door created between the inner and outer door skins 2 and 6. The insulating foam 7 may be added to the interior of the outer door skin 2 prior to fitting the inner door skin 6. Alternatively the foam 7 may be applied to an inner surface of the inner door skin prior to assembling the outer door skin to the inner door skin. In a further alternative construction method, the foam may be injected into the interior cavity through a hole in either the inner or outer door skins.

Figure 2:
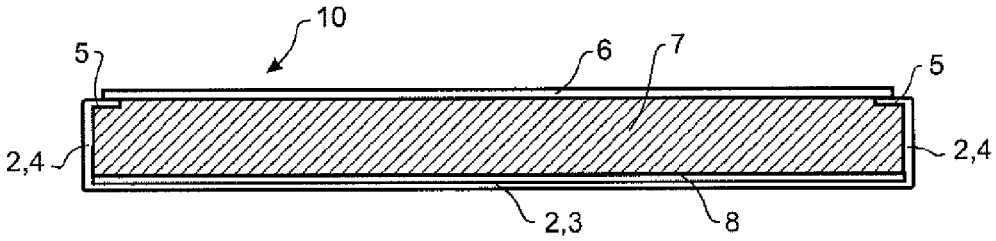
FIGS. 2 to 4 are cross sectional views of various embodiments of an appliance door according to the present invention.

FIG. 2 is a cross section through a refrigerator door 10 comprising an intermediate layer of material 8 between the outer door skin 2 and the foam insulation 7. In the preferred embodiment of the present invention, the intermediate layer 8 is a sheet of magnet material. Preferably the sheet of magnet material comprises a permanent magnet material integrally formed with a polymer sheet. Such magnet sheet material is widely available and is commonly used for removably applying advertising to metal panels, for example applying signage to a motor vehicle. The permanent magnet material may be a powdered ferrite, Samarium Cobalt, Neodymium Iron Boron or other material suitable for use as a permanent magnet. The permanent magnet material is preferably integrally formed with a polymer such as PVC or CPE into a sheet to form the magnet sheet material 8.

Once the outer door skin is formed and ready for assembling with other door components, the magnet sheet 8 is applied to an inner surface of the front panel. The door is then manufactured as previously known in the art. As foam is applied to the internal cavity of the door, the foam becomes bonded to the magnet sheet material. The foam is not bonded to the front door panel where there is magnet sheet material present. During foaming of the internal cavity of the door, the foam temperature is elevated above ambient temperature. As the foam cools it may shrink. Also, the foam tends to shrink due to other causes over a prolonged time period post manufacture. For example, an amount of shrinkage has been noticed that occurs over several months post manufacture. The foam shrinkage may not be uniform throughout the door. In localised areas where there is excessive foam shrinkage, the magnet sheet material 8 detaches from the inside surface of the front panel 3 of the door, preventing deformation of the front panel 3 of the door.

Excessive foam shrinkage is considered to be an amount of deflection of the door front panel that would be noticeable to the eye of an observer. Such an amount can be very small, for example a fraction of a millimeter.

Figure 3:
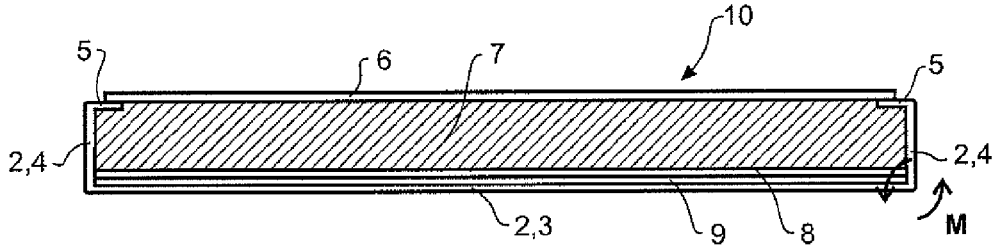

A door according to the present invention may further comprise a second intermediate material interposed between the magnet sheet material 8 and the rear surface of the door front panel 3, as shown in FIG. 3. Preferably the second intermediate material 9 is a sheet of paper. The second intermediate sheet assists air to permeate between the magnet sheet 8 and the front panel 3 to allow the front panel to release from the magnet sheet. Without the second intermediate layer, suction between the front panel and the magnet sheet may prevent the front panel from releasing from the magnet sheet. However, a second intermediate layer is not necessarily required to alleviate this. Various embodiments of magnet sheet for use as an intermediate layer without a secondary layer are described below. Such embodiments may also be used with a secondary intermediate layer, but are suited for use without a secondary intermediate layer. A further factor for which a secondary material may be used is to space the magnet sheet from the front panel by the thickness of the second intermediate sheet, thereby reducing the magnetic force on the front panel 3. A reduced magnetic force allows the front panel to detach from the magnetic sheet more easily.

Figure 4:
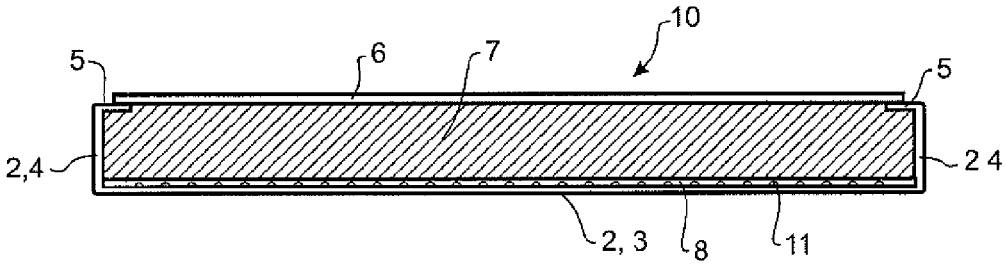

The magnet sheet may include a series of grooves 11 in the surface of the magnet sheet in contact with the rear surface of the front panel, as illustrated in FIG. 4. The grooves may extend to at least one edge of the magnet sheet to allow air to pass into any area of shrinkage to allow the front panel to release from the magnet sheet, air being available at an edge of the door. Alternatively the grooves may not extend to an edge of the sheet. For example there may be a source of air provided via a hole through the front panel of the door. Preferably the grooves are spaced close enough to ensure at least one groove will reach any area of localised shrinkage. Alternatively, the surface of the magnet sheet in contact with the rear surface of the front panel may be textured, to assist air to pass into an area of shrinkage. There may not be a source of air external to the door. The textured surface or grooves may provide enough air trapped between the magnet sheet and the rear surface of the front panel to allow the magnet sheet to separate from the rear surface of the front panel. Alternatively the rear surface of the front panel may include grooves or a textured surface, rather than the sheet of magnet material.

Preferably the magnet sheet has a magnetic field that provides an attraction force between the magnet sheet and a magnetic material in contact with the magnet sheet of approximately 10 g/cm$^2$. The inventors have found an attraction force of 7 g/cm$^2$ is suitable.

Figure 5:
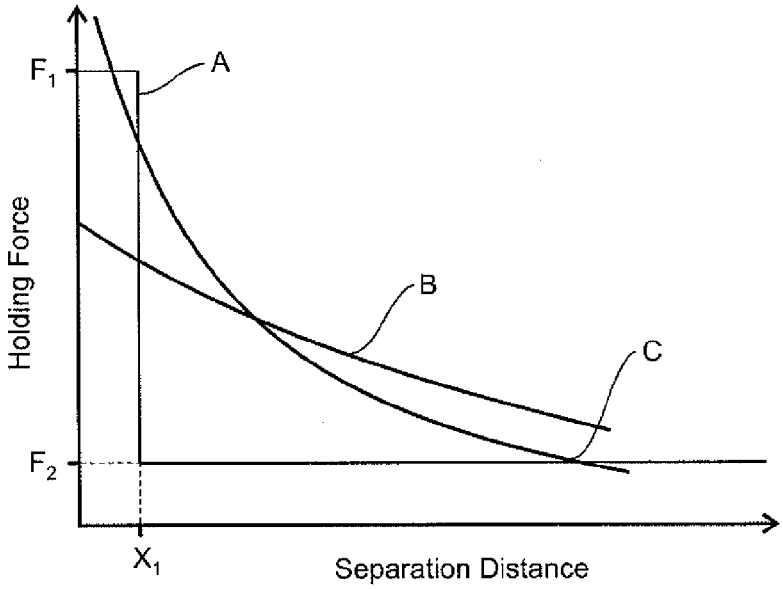
FIG. 5 is a chart indicating the desired characteristics of an intermediate material between the insulating foam of an appliance door and the door front panel, and the characteristics of two different intermediate materials.

Desired characteristics of an intermediate layer are indicated by line 'A' in FIG. 5. Ideally the intermediate layer will require a relatively high force to pull away from the front panel up to a separation distance $x_1$. Force F1 is sufficient to securely hold the front panel generally. However, in areas of localised shrinkage, F1 is insufficient to deform the front panel allowing the front panel to pull away from the intermediate material. For a separation distance greater than $x_1$, the desired characteristic of the intermediate layer is a relatively low force.

A magnet sheet material may be developed that has a particular magnetic strength characteristic well suited to the application of an intermediate layer in an appliance door as described above with reference to FIGS. 2 to 4. The magnetic strength characteristic may be varied by changing the magnetic pole density of the sheet. A high pole density in any area of the sheet is achieved by having many changes in magnet polarity along a path over that area. For example, many separate poles of alternating polarity can be arranged side by side to achieve a high pole density. Alternatively, many changes in polarity could be achieved with a convoluted single magnetic pole surrounded by material of the opposite polarity. For example, a serpentine or spiral shaped single magnetic pole surrounded by material of the opposite polarity could be used to achieve a high pole density; a path across the convoluted shape would have many changes in magnetic polarity. An area of the same size having a lower pole density would have a lower number of changes in magnetic polarity along a path over that area.

With reference to FIG. 5, Line 'B' indicates the characteristics of a first magnet sheet material (material B) and line 'C' indicates the characteristics of a second magnet sheet material (material C). Material B has a lower density of poles compared to material C.

Figure 6:
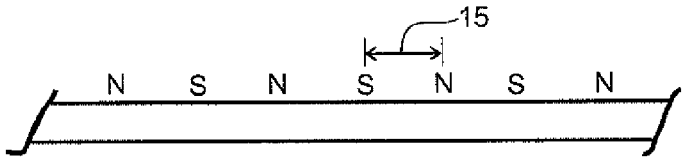
FIG. 6 is a schematic representation of a cross section of an intermediate sheet material for use in the construction of an appliance door according to another embodiment of the present invention.

A lower magnetic density is less desirable as the magnetic strength does not decrease as rapidly as the magnet strength of a material having a higher density of magnetic poles for increasing separation distance. A higher magnetic density provides an increased magnetic field strength at close separation distance, and the magnetic strength decreases more rapidly. The characteristic of a magnet sheet with a high pole density approaches the characteristic of the ideal intermediate material and is therefore more desirable. Preferably the magnet sheet has a magnetic pole density with changes in magnetic polarity occurring at a pitch of 0.5 mm-5 mm. Most preferably the pole pitch is approximately 1.5 mm. FIG. 6 is a schematic representation of a cross section through a portion of a magnet sheet with changes in magnetic polarity occurring at a pitch 15.

Figure 7:
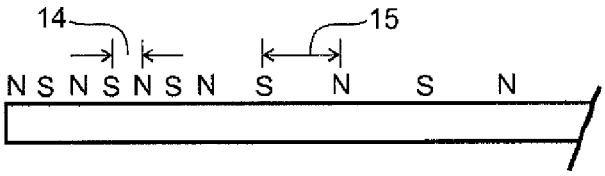
FIG. 7 is a schematic representation of a cross section of an intermediate sheet material for use in the construction of an appliance door according to another embodiment of the present invention.

A further embodiment of the present invention is an intermediate sheet comprising a varying pole pitch. For example, as shown in FIG. 7, the magnet sheet for use as an intermediate layer between the front panel and the insulating foam comprises a smaller pole pitch 14 in an edge region of the sheet and a larger pole pitch 15 through a central region of the sheet. The transition between the smaller and larger pitch regions may be gradual over a portion of the sheet or may occur as a step change. The shorter pole pitch provides a region of higher or stronger magnetic force at a small separation distance, whereas the larger pole pitch provides a region of lower or weaker magnetic force for the same small separation distance.

It is desirable to have a higher resistance to separation of the front panel from the insulating foam in edge regions of the front sheet. The thermal expansion coefficient of the inner door skin 6 may be greater than the thermal expansion coefficient of the outer door skin material 2. A typical refrigerator door has a plastic inner door skin and a steel outer door skin. For example, the inner skin may be manufactured from ABS or HIPS plastic. During manufacture, the temperature of the door materials is elevated above room temperature. As the materials cool to room temperature post manufacture, the inner door skin 7 contracts more than the outer door skin 2. Furthermore, during use of the refrigerator, the inside of the refrigerator is cold, causing additional contraction of the inner door skin 7. The additional contraction of the inner door skin compared to the outer door skin can create a bending moment at the edge positions between the front 3 panel and edges 4 of the door skin, the bending moment is indicated by the arrows labelled 'M' in FIG. 3. Bending moment M causes the front panel 3 to flex outwardly. Therefore a higher resistance to separation of the front door panel from the insulating foam in the edge region may be desired.

Figure 8:
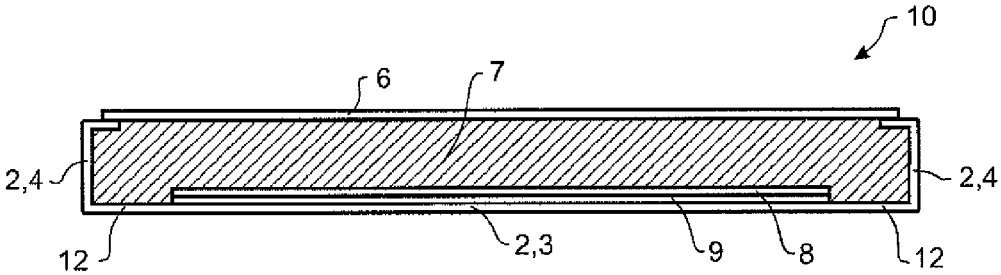
FIGS. 8 to 12 are cross sectional views of further embodiments of an appliance door according to the present invention.

A magnet sheet with a closer pole pitch in the edge region of the door front panel provides a higher magnetic force at a small separation distance to hold the edge regions of the front panel. Alternatively the sheet of magnet material does not extend all the way to the edges of the front panel so that the insulation foam is bonded to the rear surface of the front panel in the edge regions of the front panel. For example the intermediate sheet material may be smaller than the front panel of the door to provide a gap between the edge of the door panel and the edge of the magnetic sheet of approximately 30 mm. In a preferred embodiment where there is a sheet of paper 9 between the magnet sheet 8 and the front panel, both the paper and the magnet sheet do not extend all the way to the edges of the front panel 3 so that the insulation foam 7 is attached to the rear surface of the front panel in the edge regions 12 of the front panel, as shown in FIG. 8.

Figure 9:
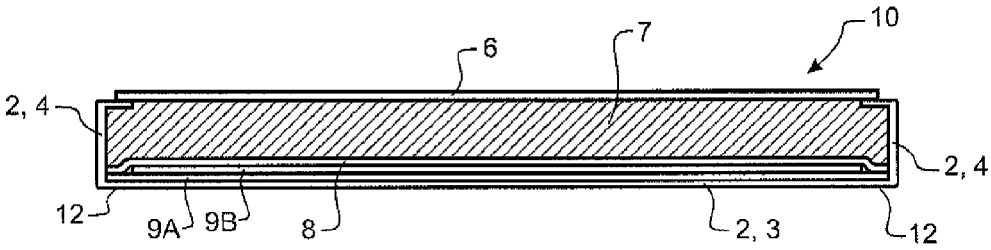

An alternative embodiment achieving a variation in magnet strength is the use of a secondary intermediate material 9 of varying thickness in between the magnet sheet material 8 and the door front panel 3. The thicker the secondary material is, the further the magnet sheet is spaced from the front panel and therefore the weaker the magnetic force holding the panel becomes. For example, the secondary intermediate material may comprise two sheets of paper as shown in FIG. 9. A first sheet of paper 9A extends over the entire surface of the rear surface of the door front panel. A second sheet of paper 9B does not extend fully to the edges of the door front panel, so that a single thickness of paper is present between the magnet sheet 8 and the door front panel 3 in the edge regions 12, and a double paper thickness across the rest of the central portion of the door front panel. The magnetic force provided at the edges of the door front panel is therefore greater in the edge regions of the door front panel. Alternatively a single sheet of secondary material may be provided that does not extend fully to the edges of the front panel so that the magnet sheet material is in contact with the door front panel in the edge regions of the door only.

Figure 10:
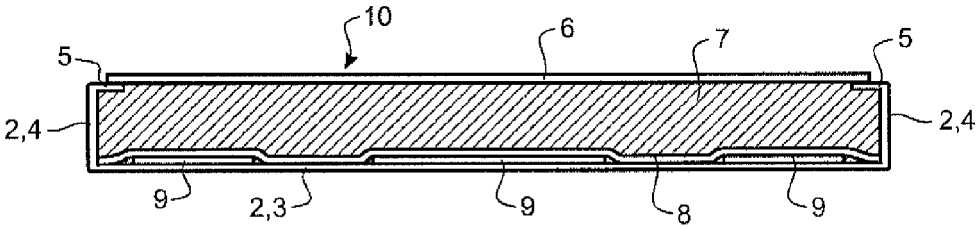

Furthermore, the secondary sheet material may cover some sections of the door front panel only as shown in FIG. 10, so that the magnet sheet material contacts the door front panel in areas where the secondary material is absent. In this way the strength of the magnetic force provided to the door front panel by the magnet sheet can be tailored to overcome particular shape defects. For example, in a refrigerator door may include a water dispenser apparatus including a water conduit passing through a section of the door. In the area of the water conduit shape defects may be expected. Therefore in this area, a secondary material may be provided between the door front panel and the magnet sheet to allow the door front panel to release from the magnet sheet more easily, whereas in other areas of the door no secondary sheet will be provided. Alternatively a single layer of secondary sheet material comprising a varying thickness may be provided across the full surface of the door front panel.

Alternatively the distribution or strength of the magnetic poles of the sheet material may be tailored to vary the magnetic force characteristics over the sheet material. One method of achieving this has been described above, that is to have different pole densities in different areas of the sheet. An alternative method is to alter or vary the level of magnetisation across the sheet material. For example, the pole pitch may be constant across the sheet material, but one region of the sheet may be magnetised to a higher level compared to other regions of the sheet. For example, one or more regions of the magnet sheet material may be fully magnetised while other regions of the magnet sheet may be partially magnetised. Alternatively one or more regions of the sheet may be un-magnetised. An un-magnetised region provides no magnetic field.

Figure 11:
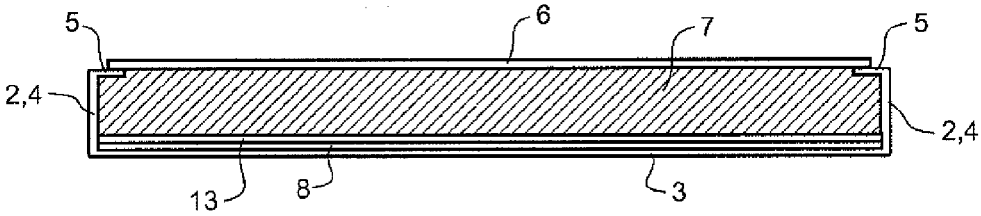

Various forms of the present invention have been described. Any combinations of any two or more embodiments described are deemed to be incorporated herein as if individually set forth. Also, alternative arrangements are considered within the scope of the invention. For example, the various embodiments described above require a door front panel formed from a material that is attracted to a permanent magnet. (Such materials have a high relative magnetic permeability.) For example the outer door skin may be formed from a sheet of ferritic stainless steel or other material having sufficient magnetic permeability such that there is sufficient force between the permanent magnet and the door front panel to hold the door front panel securely. However, the present invention may be incorporated into an appliance comprising a door with an outer door skin formed from a material that is not attracted to a permanent magnet, for example a martensitic stainless steel. With reference to FIG. 11, in this embodiment, the magnet sheet material 8 is bonded to a rear surface of the door front panel 3. A secondary intermediate material 13 that is attracted to the magnetic field of the magnet sheet material is provided between the magnet sheet material and the insulation foam. For example, the secondary intermediate material may be a second magnet sheet material, or a sheet of ferritic steel. The foam 7 is bonded to the secondary intermediate material 13. Shrinkage of the insulating foam causes the secondary intermediate material 13 to flex and detach from the magnet sheet material 8 bonded to the rear surface of the door front panel 3 to prevent shape defects in the door front panel. The secondary intermediate material could be a reinforcing material to assist with maintaining the flatness of the foam 7.

Alternatively, the foam 7 could be bonded to a secondary intermediate material. The secondary intermediate material could act to reinforce the foam. The intermediate magnet sheet could then be bonded to the secondary material. A third intermediate material that is magnetically attracted to the magnet sheet could be attached to the rear surface of the front panel. Where movement due to deformation of the foam occurs, the magnet sheet separates from the third intermediate material bonded to the rear surface of the front panel.

A further benefit of a secondary intermediate material 13 comprising a sheet of steel bonded to the foam is that the secondary intermediate sheet helps to keep the outer surface of the insulating material flat. This in turn has a positive consequence on the shape of the door front panel.

Other variations in door structure are conceivable, for example a sheet of ferritic steel (or other material attracted to the magnet material) could be bonded to the rear surface of a door front panel made of martensitic stainless steel (or other material not attracted to the magnet material), with an intermediate magnet sheet material between the ferritic steel sheet and the insulating foam, the insulating foam bonded to the magnet sheet.

In all embodiments of the present invention described above, the door structure comprises at least one sheet of magnet material located between the door front panel and the insulating foam. A secondary intermediate material may also be present depending on the particular embodiment. In an alternative door structure, the door comprises a door front panel having a level of magnetisation. An intermediate material is provided between the filler material and the door front panel. The intermediate material is attached to the filler material and is attracted to the magnetised door front panel. In localised areas where there is excessive foam shrinkage, the intermediate material detaches from the inside surface of the front panel of the door, preventing deformation of the front panel of the door.

Figure 12:
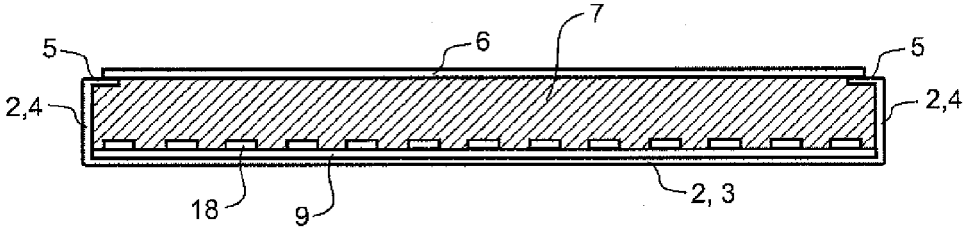

A further alternative embodiment of the present invention comprises an array of discrete permanent magnets located between the door front panel and the insulating foam. The array of discrete magnets is an alternative to a sheet of intermediate magnet material. For example, the discrete magnets may be separate pieces of sheet magnet material, each piece spaced apart from adjacent pieces. With reference to FIG. 12, the foam is prevented from being bonded to the rear surface of the door front panel 3 by an intermediate sheet material 9. The intermediate sheet material is preferably a sheet of paper. The permanent magnets 18 are located between the intermediate sheet 9 and the foam 7. Preferably during manufacture the intermediate sheet material 9 is located against the rear surface of the outer door skin front panel 3 and held in place by placing the permanent magnets 18 spaced apart in an array across the door front panel. Foam material 7 is then is formed around the permanent magnets to hold the magnets in place. The foam is bonded to the magnets and a rear surface of the intermediate sheet 9. The magnets 18 hold the door front panel 3 securely, each magnet 18 providing a magnetic force to the door front panel 3 through the intermediate sheet 9. However in areas of foam shrinkage, the door front panel is released from a magnet or magnets and the intermediate layer 9 to avoid shape defects in the door front panel 3.

The discrete permanent magnets may be arranged uniformly over the area of the rear surface of the front door panel. Alternatively, the magnets may be arranged in areas of varying density. Some areas may comprise a higher number of magnets per door surface area, and other areas may comprise a lower number of magnets per door surface area, the arrangement being similar in concept to earlier embodiments comprising a varying magnetic field by utilising a magnet sheet with varying magnet pole density or a variable thickness secondary sheet material between the magnet sheet material and the door front panel. The magnets may also vary in size, thickness, strength, and pole arrangement. Furthermore, intermediate sheet 9 may be absent in some areas of the front panel, the foam being permanently coupled to the front panel in these areas.

The various embodiments described herein provide a door with a front panel that remains firm to touch except in areas where there is excessive foam shrinkage causing the door front panel to release from the magnet material within the door. Such areas may be relatively small and the touch or feel of the door front panel is therefore not affected over most of the area of the front panel of the door. Doors that comprise a resilient material between the foam and the door front panel in order to overcome shape defects can have a soft touch or feel over most of the area of the door front panel. The magnet sheet or discrete magnets within the door hold the front panel securely, preventing the door front panel from becoming loose which can happen in doors where the front panel is not bonded to a secure member within the door such as the insulating foam.

The various embodiments have been described with reference to shrinkage of the internal filler or insulating material of the appliance door. However, the present invention may be useful for overcoming other forms of deformation of the door inner material. For example, compression of the foam insulation may occur through a force applied to the exterior surface of the door. Such a force may compress the foam while not causing a permanent dent to the door skin. In this case the present invention allows separation of the front panel from the foam so that the compressed foam shape is not transferred to the door skin.

The foregoing description of the invention includes preferred forms thereof. Modifications may be made thereto without departing from the scope of the invention as defined by the accompanying claims.

The invention claimed is:

1. A door for an appliance comprising:

a front panel and a rear panel and edges extending between the front panel and rear panel to create an internal cavity between the front panel and the rear panel, said front panel having a rear surface, an intermediate material comprising at least one permanent magnet sheet located at the rear surface of the front panel, a filler material for filling the internal cavity, the filler material applied and bonded to the permanent magnet sheet when the intermediate material is located at the rear surface of the front panel, wherein the intermediate material retains the front panel relative to the filler material by a magnetic field of the permanent magnet sheet, the permanent magnet sheet releasing a portion of the front panel relative to the filler material upon excessive localized deformation of the filler material.

2. A door as claimed in claim 1, wherein the front panel is magnetically attracted to the magnet sheet.

3. A door as claimed in claim 2 wherein the intermediate material further comprises a second material, the second material being nonmagnetic and positioned in between the magnet sheet and the rear surface of the front panel thereby spacing the magnet sheet from the rear surface of the front panel by the thickness of the second material, the magnet sheet releasing a portion of the front panel and the second material relative to the filler material upon excessive localized deformation of the filler material.

4. A door as claimed in claim 3 wherein a first portion of the rear surface of the front panel is covered by the second material and a second portion of the rear surface of the front panel is not covered by the second material.

5. A door as claimed in claim 4 wherein the second portion is an edge region of the front panel.

6. A door as claimed in claim 1 wherein the magnet sheet is bonded to a second material, the second material being bonded to the filler material, at least a portion of the front panel retained relative to the filler material by the magnetic field of the magnet sheet.

7. A door as claimed in claim 6 wherein the front panel is magnetically attracted to the magnet sheet.

8. A door as claimed in claim 6 wherein the intermediate material further comprises a third material bonded to the rear surface of the front panel, the third material being magnetically attracted to the magnet sheet, the magnet sheet releasing a portion of the third material and the front panel relative to the filler material upon excessive localized deformation of the filler material.

9. A door as claimed in claim 1 wherein the intermediate material further comprises a second material bonded to the rear surface of the front panel, the second material being magnetically attracted to the magnet sheet, the magnet sheet releasing a portion of the front panel and the second material relative to the filler material upon excessive localized deformation of the filler material.

10. A door as claimed in claim 1 wherein the magnet sheet covers a first portion of the rear surface of the front panel, the filler material being permanently coupled to a second portion of the front panel not covered by the magnet sheet.

11. A door as claimed in claim 10 wherein the second portion is an edge region of the front panel.

12. A door as claimed in claim 1 wherein the intermediate material comprises a plurality of permanent magnets spaced apart over an area of the front panel.

13. A door as claimed in claim 1 wherein the magnet sheet is formed of permanent magnet material integrally formed with a polymer sheet.

14. A door as claimed in claim 1 wherein the filler material is insulation material.

15. A door as claimed in claim 1 wherein the filler material is a foam material.

16. A door as claimed in claim 1 wherein the door is a refrigerator door.

17. A door for a refrigerator comprising:

a front panel and a rear panel and edges extending between the front panel and rear panel to create an internal cavity between the front panel and the rear panel, said front panel having a rear surface, an intermediate material comprising at least one permanent magnet sheet located at the rear surface of the front panel, an insulation material for filling the internal cavity, the insulation material applied and bonded to the permanent magnet sheet when the intermediate material is located at the rear surface of the front panel, wherein the intermediate material retains the front panel relative to the insulation material by a magnetic field of the permanent magnet sheet, the permanent magnet sheet releasing a portion of the front panel relative to the insulation material upon excessive localized deformation of the insulation material.

18. An appliance including a door as claimed in claim 1.

19. A door as claimed in claim 2 wherein the front panel comprises stainless steel sheet magnetically attracted to the magnet sheet.

* * * * *